United States Patent [19]

Pejouhy et al.

[11] Patent Number: 4,622,739

[45] Date of Patent: Nov. 18, 1986

[54] METHOD OF PROVIDING AN IMPROVED SEAL FOR THERMOSTATIC SWITCH HOUSINGS

[75] Inventors: Radi Pejouhy, Marshfield, Mass.; Stephen J. Benner, Woonsocket, R.I.; Joshua Loring, Wrentham, Mass.

[73] Assignee: Texas Instruments Incorporated, Dallas, Tex.

[21] Appl. No.: 775,192

[22] Filed: Sep. 12, 1985

Related U.S. Application Data

[63] Continuation of Ser. No. 565,949, Dec. 27, 1983, abandoned.

[51] Int. Cl.[4] ..... H01H 11/00

[52] U.S. Cl. ..... 29/622; 174/52 S

[58] Field of Search ..... 29/622; 413/9, 15; 361/272; 174/52 S

[56] References Cited

U.S. PATENT DOCUMENTS 1,843,545 2/1932 Dival ..... 413/59

3,430,177 2/1969 Audette ..... 29/622

3,842,574 10/1974 Dickey ..... 413/9

4,416,576 11/1983 Kawamata ..... 413/59

*Primary Examiner*—Howard N. Goldberg

*Assistant Examiner*—P. W. Echols

*Attorney, Agent, or Firm*—John A. Haug; James P. McAndrews; Melvin Sharp

[57] ABSTRACT

A miniature thermostatic switch of the type that can be inserted into the windings of electrical devices in order to sense the temperature of the windings is disclosed having an improved liquid tight seal to prevent seepage into the switch of varnish or other liquids to which the windings are subjected during assembly. The switch has a two part metallic housing with lips of one part clamped to the other part with an electrically insulating gasket interposed between the two parts. After assembly of the switch the gasket material is softened and the lip is subjected to a force to deform the gasket material, wetting the housing contiguous to the gasket and forming fillets therebetween to completely fill in any voids between the gasket and the contiguous housing.

12 Claims, 7 Drawing Figures

METHOD OF PROVIDING AN IMPROVED SEAL FOR THERMOSTATIC SWITCH HOUSINGS

This application is a continuation of application Ser. No. 595,949 filed Dec. 27, 1983, now abandoned.

This invention relates generally to thermostatic switches and more particularly to a method for providing an improved liquid tight seal between the component parts of the housing.

The provision of thermally responsive switches suitable for protecting various electrical apparatus from over current and over temperature conditions and for mounting within the windings of such apparatus is well known. For example, a swtich of this type is described and claimed in U.S. Pat. No. 3,430,177 and is shown to comprise an electrically and thermally conductive can and lid separated from each other by an electrically insulating adhesive gasket. A thermostatic snap acting element and movable contact are mounted on either the can or the lid while a stationary contact is mounted on the other of the two parts. The can has a bottom wall with an upstanding side wall extending therefrom to form a switch cavity and is provided with an opening at its top with a flange formed circumscribing the opening. Two portions of the flange are provided with an extension or lip which is bent over to clampingly engage the lid through the gasket and close the switch chamber. As stated in the patent, the gasket may be, for example, a polyester coated on each side with a thermosetting adhesive so that the clamping action of the flange serves to maintain the can and lid in intimate contact through the gasket while the thermosetting adhesive is heated and cured to effect a bond among the parts to prevent seepage of varnish or other media which would adversely affect the calibration and operation of the switch.

While many millions of switches have been made in accordance with the referenced patent, there has been a recurring problem with the integrity and effectiveness of the seal with a certain number of such switches. That is, due to a slight imperfection such as a scratch on or misalignment of the mating parts of some switches liquid material tends to seep in during the winding coating process and thereby deleteriously affect the calibration and effectiveness of the switches. Even if the percentage of switches which have such a problem is relatively small and the cost of a particular switch is modest, the problem becomes critical because the controlling cost becomes that of the entire apparatus rather than just the switch. Further, the efficiency of the very purpose of the switch to provide assurance that the apparatus will be protected from deleterious effects of over temperature and over current conditions becomes questionable unless adverse effects of leakage into the switch chamber are effectively overcome.

SUMMARY OF THE INVENTION

It is therefore, an object of the invention to provide a method for making a thermally responsive switch suitable for installing in the windings of an electrical apparatus which has an improved seal.

Another object of the invention is to provide a method for making a liquid tight seal between component parts of a thermostatic switch housing which will be suitable for mass produced devices, especially of the type set forth in the referenced patent.

Yet another object is the provision of a method for sealing miniature switches which does not add significant cost to producing the switch yet which is reliable and tolerant to imperfections in the component parts of the switches.

Other objects and features of the invention will become more readily understood from the following detailed description and appended claims.

Briefly, in accordance with the invention a metal housing is formed with a recess therein open at one side circumscribed by a ledge having lip portions extending outwardly from the ledge. A gasket formed of electrically insulative material having at least a layer of softenable resinous material such as a thermoplastic or a curable thermosetting material is placed on the ledge and a lid is placed over the gasket to close the opening. The lip portions are bent over to clamp the lid to the housing with the gasket interposed therebetween. The gasket material is then heated to soften it by rapidly heating the can and lid as by induction heating and promptly placing sufficient force on the gasket through the lip to deform the layer and form a fillet between the gasket and the housing.

DESCRIPTION OF PREFERRED EMBODIMENT

Figure 1:
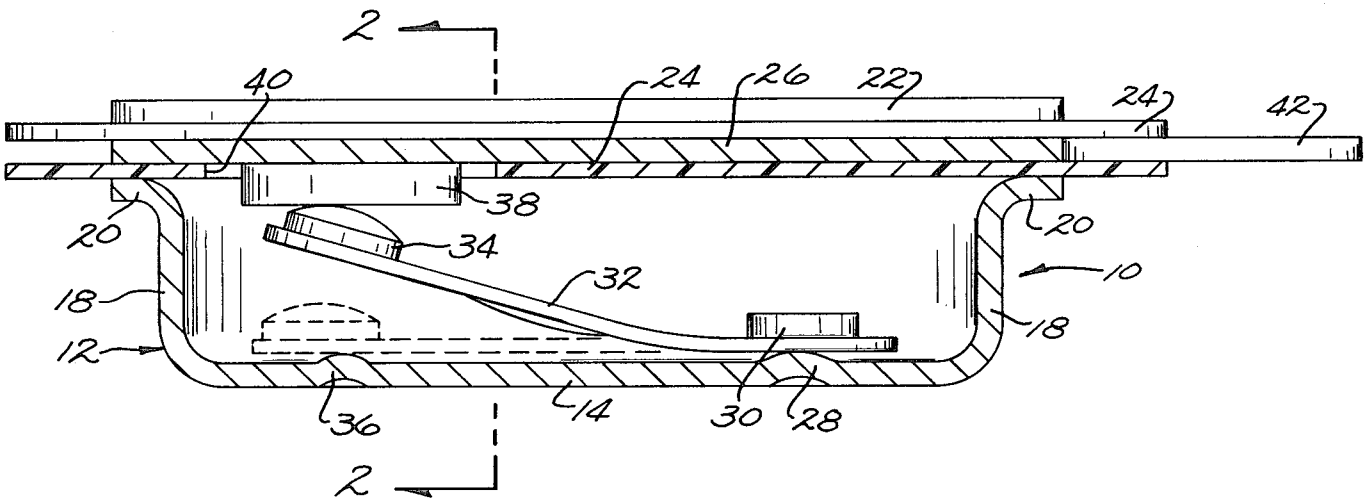
FIG. 1 is a cross sectional front plan view taken through the center of a switch with which the present invention may be utilized.
Figure 2:
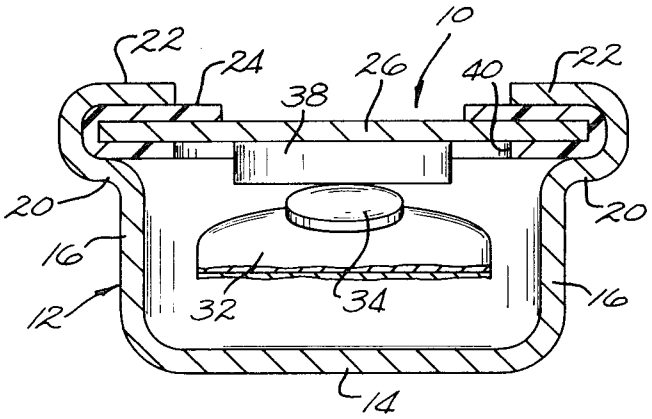
FIG. 2 is a cross sectional plan view taken on lines 2—2 of FIG. 1.

Referring to the drawings, FIGS. 1 and 2 show a thermally responsive switch 10 with which the present invention can be practiced. Switch 10 includes a generally parallelpiped, open ended, electrically and thermally conductive metal can or housing 12 having a bottom 14 and depending opposed front and back side walls 16 and end walls 18. Walls 16 and 18 have a free end formed into a ledge portion 20 extending around or circumscribing the open end of the housing. A portion (not shown) of the ledge extends from the housing to serve as an integral terminal. Side walls 16 are formed with lip portions 22 extending from opposed portions of ledge 20 to facilitate attachment of a gasket 24 and lid 26 to be described below. Indentation 28 is formed in the housing bottom to provide a weld projection inside the housing bottom, preferably using a conventional weld button 30 to mount a bimetal element 32 in cantilever relation to the housing bottom to support a movable contact 34 of conventional contact material at the distal free end of bimetal member 32. Bimetal member 32 preferably has a dished portion intermediate its ends so that the member is adapted to move with snap action from a first position shown in solid lines in FIG. 1 to a second position shown in broken lines when the bimetal is heated to a selected actuating temperature. The bimetal is also adapted to move with snap action back to said first position when the bimetal member subsequently cools to a relatively lower reset temperature. An indentation 36 in the housing bottom provides a stop for limiting movement of the bimetal member as it snaps to the second broken line position. Alternatively, of course, other thermal responsive switch means of a conventional type may be incorporated within the switch housing for electrically connecting and disconnecting a circuit on the occurrence of an overload current or over temperature condition in the switch.

A stationary electrical contact 38 of conventional contact material is mounted in a conventional manner as by welding to lid 26, a generally flat plate like element, received at and closing the open end of housing 12.

Electrically insulative gasket 24 is placed on top of housing 12 on ledge 20 in order to electrically separate housing 12 from lid 26. A window 40 is cut out of the gasket to expose stationary contact 38 to the interior or switch cavity of the housing. Gasket 24 is formed of suitable electrically insulative material capable of withstanding elevated temperatures and capable of being softened for purposes to be explained below.

Lid 26 is also provided with an integrally formed tab 42 which serves as a terminal member. After placement of gasket 24 and lid 26 on ledge 20 of housing 12 extensions or lips 22 are bent over to clampingly attach the gasket and lid to the housing to complete the switch assembly. The size of gasket 24 is such that it extends beyond lips 22 in order to maintain electrical separation of the lid from the housing after lips 22 are bent over.

An example of a particular gasket material which has been successfully used in the FIG. 1, 2 switch is a multilayer material such as Estermat series 2000 polyester mat/polyester film of Keene Corporation's Chase-Foster Division.

Figure 6:
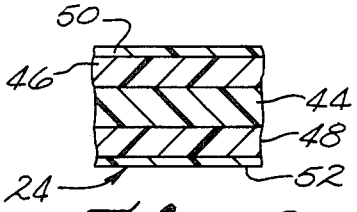
FIG. 6 is a cross sectional view of a portion of a piece of material useful as a sealing and electrically insulating gasket.

As seen in FIG. 6, the multilayer material comprises a center layer 44 of a polyester such as Mylar, a polyethylene terephthalate resin furnished by E. I. du Pont de Nemours Co. sandwiched between a pair of layers 46, 48 respectively comprising a polyester matt impregnated with a thermoset resin and finally having respective outer surfaces 50, 52 of a thermoplastic adhesive material. As set forth in the above referenced patent, after assembly the switch assembly is subjected to heat to cure the thermoset resin to obtain a suitable seal of the gasket to prevent seepage of varnish or the like into the switch cavity. This resulted in a seal which was effective only if certain factors were satisfied such as, if the mechanical fit of the parts was uniformly consistent. However, in some cases minor barbs, scratches, or other irregularities occurred on ledge 20 or the outer peripheral portion of lid 26 thereby adversely effecting the ability of the seal to prevent seepage.

By means of the present invention the seals are made essentially one hundred percent effective by rendering the gasket material soft and then deforming the gasket material through a force exerted on lips 22, and a reaction force on ledge 20, to wet the can and lid and cause a fillet to be formed between the gasket and the housing and lid respectively.

Figure 3:
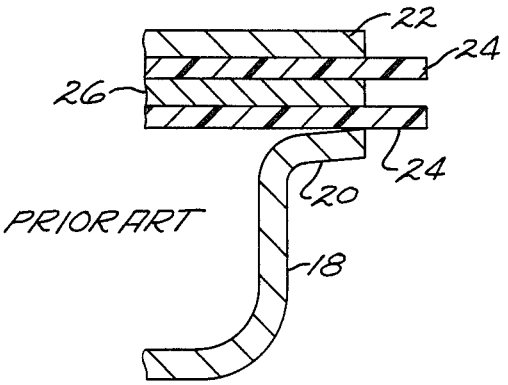
FIG. 3 is an enlarged cross sectional view of a portion of the FIG. 1 switch showing details of the end seals of the several components of the switch housing as use prior to the present invention.
Figure 4:
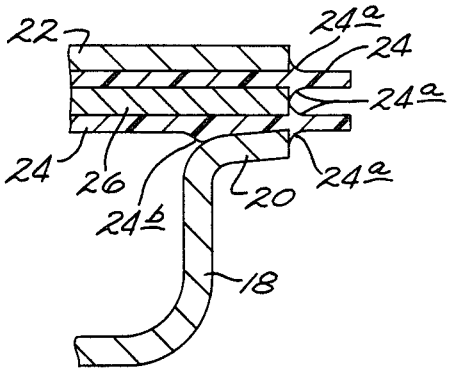
FIG. 4 is a view similar to FIG. 3 showing details of the end seals of the several components of the switch housing pursuant to the present invention.
Figure 5:
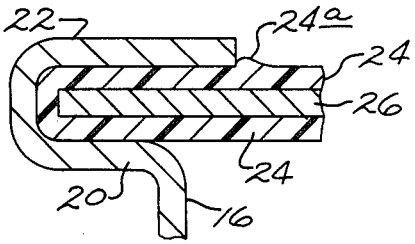
FIG. 5 is a view similar to FIG. 4 showing details of the front and back seals of the several components of the switch housing pursuant to the invention.
Figure 7:
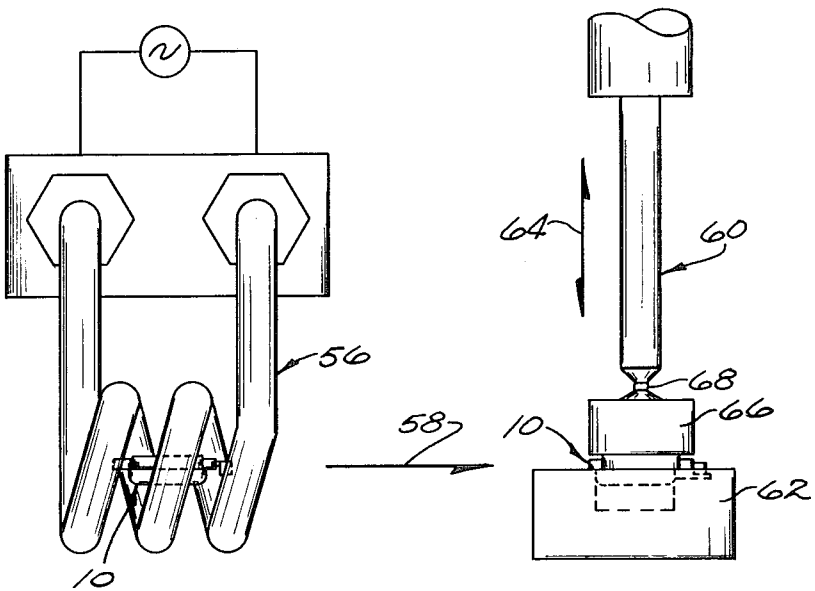
FIG. 7 is a schematic diagram showing a heating step followed by a deforming step employed in producing the improved seal in accordance with the instant invention.

As seen in FIG. 7, a switch assembly 10 having a gasket incorporating Mylar which melts at approximately 480° F. is rapidly heated, preferably by an induction heater 56 so that housing 12 is between approximately 350°-600° F. and preferably in the order of 500° F. with the less massive lid 26 being somewhat lower in temperature. As indicated by arrow 58, switch 10 is then placed in a press 60 with the gasket softened by heat transferred to it from the housing and lid and a force is applied to lip 22 preferably through a pneumatically operated ram 66 which is movable toward and away from platen 62 as indicated by arrow 64 bending lip 22 toward ledge 20. It is preferred to have a universal swivel connection 68 between ram 66 and the press so that the force transferred to lips 22 will be evenly distributed. Lid 26 is pushed into the softened gasket material to deform it causing the gasket material to wet adjacent portions of the housing and lid and form fillets **24*a* (FIGS. 4 and 5) to completely cover any irregularity in fit between the respective housing components. As seen in FIG. 3, ledge 20 may be slightly inclined toward lid 26 so that it meets gasket 24 virtually in a line rather than a surface. By softening the resinous material of the gasket and pushing down on lip 22 not only are fillets 24*a* formed on the outer peripheral surfaces of the housing and lid but also the wedge shaped volume between the inclined ledge 20 and lid 26 is filed in by fillet 24*b*** to greatly increase the contiguous surface areas of the ledge and gasket.

The switch housing is heated not only to transfer sufficent heat to the gasket material to soften it but also to heat the air inside the switch causing it to expand and force a portion of it out of the switch chamber before the gasket is deformed. This creates a partial vacuum in the switch cavity which provides advantageous results from the viewpoint of switch life and operation. In order to optimize fillet formation the gasket material should be deformed promptly after being raised to the softening temperature before any appreciable curing occurs. Satisfactory results have been obtained when the deforming step takes place at least within approximately three to five seconds of the heating step however preferably it should be within approximately one second. Inductive heating has been very effective since it heats up the switch housing essentially instantaneously to obviate possible deleterious effects of overheating of the gasket material.

By way of example switches such as that shown in FIGS. 1 and 2 are very small in physical size so that they can be received in the windings of small electrical appliances, e.g. fractional horsepower motors. Typically switch 10 is 0.775 inch long by 0.410 inch wide by 0.185 inch high and weighs in the order of 1.8 grams. The housing may be formed of 0.015 inch cold rolled steel, for example AISI 1006, 1008, or 1010, preferably plated with nickel-zinc and lid 26 may be formed of 0.020 inch cold rolled steel, for example SAE 1008 or 1010, again preferably plated with nickel-zinc. With such a switch it has been determined that a range of 300 to 600 pounds force on lips 22 is generally sufficient to deform gasket 24 and optimally 500 pounds to obtain the desired fillet while still maintaining the electrical separation between housing 12 and lid 26, that is, without overbending lip 22. Although the required force for bending lips 22 will vary with the dimensions and material of the lips there should be sufficient force to bend the lips to deform the gasket layer by at least 0.0005 inch and preferably in the order of 0.002 inch in order to obtain the desired filler.

The multilayer gasket material described above has relatively high temperature capability and for example, is effective for use with switches which are implanted in electrical windings which are then dipped into hot tar in the range of 300° F. to 350° F. to provide suitable electrical insulation for the winding. In certain other applications lower temperature resins could be used. Further, a single resin layer or a single layer of thermoset impregnated thermoplastic fibrous mat impregnated with thermoset can be employed for many applications.

Calibration of the switches shown in FIGS. 1 and 2 normally involves heating the switches to a selected "actuation" temperature, which is generally lower than the curing temperature of the thermoset material so that calibration can be effected prior to the final sealing operation however it is preferred to perform the final seal the first time that the gasket material is subjected to elevated temperatures to ensure that the resin is in optimum condition for softenability and wettability. In this regard, it is important that the gasket material be maintained at controlled cool temperatures prior to fabrication, and assembly in the switch and sealing thereof and that the recommended shelf life of the gasket material prior to sealing not be exceeded.

As various changes could be effected in the above method without departing from the scope of the invention, it is intended that all matter contained in the above description or shown in the accompanying drawing shall be interpreted as illustrative and not in a limiting sense.

In view of the above, it will be seen that the several objects of the invention are achieved and other advantageous results attained.

We claim:

1. A method for sealing a thermally responsive switch to prevent liquid material from seeping into the switch particularly during installation in the windings of electrical apparatus in which the windings are coated with electrically insulative material in liquid form which cures into solid material comprising the steps of forming a metallic housing having a recess therein open at one side with a ledge formed around the opening and adapted to receive a lid to close the opening, lip portions extending outwardly from one of the ledge and the lid, mounting at least a portion of the switch in the recess, selecting an electrically insulative gasket comprising at least a layer of resin, placing the gasket on the ledge, forming a switch assembly by placing the lid on the top of the gasket on the ledge to close the opening, bending the lip portions and gasket contiguous thereto the clamp the lid to the housing, softening the layer of resin, maintaining required electrical clearance between the housing and the lid as well as forming a fillet between the gasket and the housing and lid to ensure that any voids between the gasket and the housing and lid have been filled in by deforming the layer by exerting a selected force on the gasket through the lip.

2. The method according to claim 1 in which the gasket comprises at least three layers in which a layer of thermoplastic is sandwiched between outer layers of a matt of thermoplastic material impregnated with thermoset material.

3. The method according to claim 2 in which the gasket is softened by heating the assembly to between approximately 350° F. and 500° F. prior to placing the force on the gasket.

4. The method according to claim 2 in which the heating step is accomplished by induction heating.

5. A method according to claim 1 wherein the force placed on the gasket is between approximately 300 pounds and 600 pounds.

6. A method according to claim 1 wherein the force is placed on the gasket within approximately 5 seconds after heating of the housing and lid.

7. A method according to claim 1 wherein the force is placed on the gasket in less than approximately 3 seconds after the heating of the housing and the lid.

8. A method according to claim 1 wherein the force is placed on the gasket in the order of 1 second after the heating of the housing and the lid.

9. A method according to claim 1 wherein the gasket comprises a polyester film.

10. A method according to claim 9 wherein the polyester film is sandwiched between two layers of polyester matt impregnated with thermoset resin.

11. A method according to claim 10 in which the housing is heated to between approximately 250° F. and 600° F.

12. A method according to claim 1 in which the opening in the housing has four sides, the lips extend from two opposite sides and the ledge on the other two sides lie in respective planes which incline toward the lid.

* * * * *